US005876215A

United States Patent [19]

Biernath et al.

[11] Patent Number: 5,876,215

[45] Date of Patent: Mar. 2, 1999

[54] SEPARABLE ELECTRICAL CONNECTOR ASSEMBLY HAVING A PLANAR ARRAY OF CONDUCTIVE PROTRUSIONS

[75] Inventors: Rolf W. Biernath, Maplewood; Robert S. Reylek, Minneapolis, both of Minn.; Wing C. Chow, Austin, Tex.

[73] Assignee: Minnesota Mining and Manufacturing Company, Saint Paul, Minn.

[21] Appl. No.: 831,128

[22] Filed: Apr. 1, 1997

Related U.S. Application Data

[63] Continuation of Ser. No. 499,435, Jul. 7, 1995, abandoned.

[51] Int. Cl.[6] ..... H01R 9/09; H01R 4/58

[52] U.S. Cl. ..... 439/67; 29/627

[58] Field of Search ..... 439/67, 66, 80, 439/91; 29/628, 627

[56] References Cited

U.S. PATENT DOCUMENTS

| | | | |
|---|---|---|---|
| 3,646,670 | 3/1972 | Maeda et al. | 29/627 |
| 3,795,037 | 3/1974 | Luttmer | 29/628 |
| 3,811,186 | 5/1974 | Larnerd et al. | 29/626 |
| 4,157,932 | 6/1979 | Hirata | 29/885 |
| 4,655,524 | 4/1987 | Etzel | 339/59 M |
| 4,691,972 | 9/1987 | Gordon | 439/77 |
| 4,734,045 | 3/1988 | Hawkins | 439/79 |
| 4,859,189 | 8/1989 | Petersen et al. | 439/66 |
| 4,861,272 | 8/1989 | Clark | 439/79 |
| 4,932,883 | 6/1990 | Hsia et al. | 439/66 |
| 5,104,327 | 4/1992 | Walburn | 439/71 |
| 5,121,190 | 6/1992 | Hsiao et al. | 357/80 |
| 5,135,403 | 8/1992 | Sweeney | 439/71 |
| 5,158,467 | 10/1992 | Grabbe et al. | 439/71 |
| 5,171,154 | 12/1992 | Casciotti et al. | 439/67 |
| 5,174,766 | 12/1992 | Yoshizawa et al. | 439/91 |
| 5,175,409 | 12/1992 | Kent | 219/85.22 |
| 5,203,075 | 4/1993 | Angulas et al. | 29/830 |
| 5,207,585 | 5/1993 | Byrnes et al. | 439/66 |
| 5,250,848 | 10/1993 | Christie et al. | 257/778 |
| 5,259,770 | 11/1993 | Bates et al. | 439/67 |
| 5,278,724 | 1/1994 | Angulas et al. | 361/707 |
| 5,299,939 | 4/1994 | Walker et al. | 439/74 |
| 5,346,118 | 9/1994 | Degani et al. | 228/180.22 |
| 5,360,347 | 11/1994 | Irlbeck et al. | 439/67 |
| 5,375,041 | 12/1994 | McMahon | 361/749 |
| 5,377,902 | 1/1995 | Hayes | 228/254 |
| 5,378,161 | 1/1995 | Loder | 439/77 |
| 5,381,307 | 1/1995 | Hertz et al. | 361/767 |
| 5,386,341 | 1/1995 | Olson et al. | 361/749 |
| 5,394,608 | 3/1995 | Tottori et al. | 29/840 |

FOREIGN PATENT DOCUMENTS

| | | |
|---|---|---|
| 0 641 038 A2 | 3/1995 | European Pat. Off. . |
| 1 490 041 | 10/1977 | United Kingdom . |

*Primary Examiner*—Steven L. Stephan
*Assistant Examiner*—Eugene G. Byrd
*Attorney, Agent, or Firm*—H. Sanders Gwin

[57] ABSTRACT

A separable electrical connector assembly includes at least one connector body having a planar array of conductive protrusions. The conductive protrusions can be metallurgically bonded or pressure engaged with conductive contact pads on a surface of a printed circuit substrate, such as a printed circuit board or a flex circuit. In addition, a variety of decoupling means can be incorporated to substantially decouple the metallurgical bonds or pressure engagements from stresses produced by use of the separable electrical connector assembly and differential thermal expansion between the connector body and the printed circuit substrate.

36 Claims, 6 Drawing Sheets

SEPARABLE ELECTRICAL CONNECTOR ASSEMBLY HAVING A PLANAR ARRAY OF CONDUCTIVE PROTRUSIONS

This is a continuation of application Ser. No. 08/499,435 filed Jul. 7, 1995, abandoned.

FIELD OF THE INVENTION

The present invention relates to electrical connector assemblies and, more particularly, to electrical connector assemblies for making high-density, separable interconnections.

DISCUSSION OF RELATED ART

Many electronic systems use printed circuit substrates, such as printed circuit boards and flex circuits, to integrate a variety of hardware components and circuitry in a single, modular package. In electronic systems using printed circuit boards or flex circuits, it is necessary to provide electrical connector assemblies to make a variety of electrical interconnections. For example, electrical connector assemblies may be used to interconnect printed circuit boards and other printed circuit boards, printed circuit boards and flex circuits, flex circuits and other flex circuits, and either printed circuit boards or flex circuits and other system components.

The complexity of many printed circuit substrates and the space constraints present in many electronic systems require electrical connector assemblies capable of making a large number of interconnections in a limited space. An electrical connector assembly typically includes a pair of connector structures that interface with one another to form a plurality of electrical interconnections. Each connector structure must be capable of making a large number of interconnections to an interface on a printed circuit substrate. In addition, the connector structures ordinarily must be made separable from one another to enable the printed circuit substrates to be disconnected and exchanged for upgrade, repair, or modification.

Many existing separable connector assemblies use a large number of metal pins of various designs to interface between the connector structures and printed circuit substrates. The pins are electrically coupled to conductive contacts on each connector structure. When a connector structure is engaged with another connector structure to form a separable connector assembly, the contacts interface with additional contacts on the other connector structure. The pins typically are surface-mounted to pads on the printed circuit substrate on which the connector structure is mounted. The pins and pads are electrically and mechanically coupled with solder. The pads are electrically coupled to one or more conductive traces on the printed circuit substrate. The solder electrically interconnects the contacts on the connector structure and the traces on the printed circuit substrate via the metal pins.

The use of separable connector assemblies having metal pins has been recognized as a standard way to interface with printed circuit substrates. However, existing separable connector assemblies using metal pins suffer from a number of disadvantages.

For example, in many connector assemblies, the pins include a bent portion that extends beyond the periphery of the connector structure to engage a pad on the printed circuit substrate. The extension of the pin beyond the periphery of the connector structure increases the amount of substrate surface area required by the connector assembly, and thus the "footprint" of the connector assembly is increased. The extension of the pin also increases the length of the electrical signal path between the contacts on the connector structure and the traces on the printed circuit substrate. In addition, the bent portion of the pin can act as a lever arm during engagement and disengagement of the connector assembly, applying stresses that can damage the solder joints formed with the pads.

In addition, at higher interconnection densities, the metal pins must be made with smaller sizes and smaller pitch to fit a larger number of interconnections within a given space. The production of reduced pin sizes dictated by aggressive spacing requirements can be very costly and tests the limits of present manufacturing capabilities. Even if manufacturing capabilities exist, however, the reduced size tends to produce structurally weak pins that are easily damaged. In addition, the reduced pitch and size complicate both alignment of the pins with the pads, and placement of the pins within the connector structure.

Other connector assemblies include pins designed to engage through-holes in the printed circuit substrate. The pins are soldered to conductive plating within the through-holes. Such through-hole mounted pins suffer from many of the same problems as surface-mounted pins including, for example, structural weakness at small pitches. In addition, the through-hole solder connections consume space on the side of the printed circuit substrate opposite the connector body, and interrupt internal circuit layers within the printed circuit substrate.

The disadvantages associated with existing separable connector assemblies using metal pins demonstrate a need for an improved separable connector assembly. In particular, there is a need for an improved separable connector assembly providing an alternative means for electrically coupling contacts on a connector structure to contacts on a printed circuit substrate.

SUMMARY OF THE INVENTION

In view of the disadvantages associated with existing separable electrical connector assemblies, the present invention is directed to a separable electrical connector assembly having a planar array of conductive protrusions formed on at least one connector body of the assembly. The conductive protrusions are capable of being electrically coupled to a plurality of conductive contact pads on a surface of a printed circuit substrate. For example, the conductive protrusions can be metallurgically bonded or pressure engaged with conductive contact pads on a surface of a printed circuit substrate, such as a printed circuit board or a flex circuit. The use of conductive protrusions, in accordance with the present invention, enables reduction of the footprint of the overall connector assembly, and provides a more durable interconnection with the printed circuit substrate.

Engagement and disengagement of the connector body with the connector assembly can produce tension, compression, and torque capable of either damaging metallurgical bonds between the conductive protrusions and contact pads or disturbing the pressure engagement of the conductive protrusions with the contact pads. In addition, differential thermal expansion between the connector body and the printed circuit substrate produces shear force that can cause similar problems. A variety of decoupling means can be incorporated to substantially decouple the metallurgical bonds or pressure engagements from stresses produced during use of the separable electrical connector assembly.

For example, the connector assembly may incorporate flex circuits on which the conductive protrusions are mounted. The flex circuits serve to absorb at least a portion of the stresses discussed above. In addition, a compliant layer can be used as a backing for the flex circuits, providing further decoupling of the stresses. As a further decoupling mechanism, the individual connector structures can be adhesively bonded to the printed circuit substrates. Finally, standoffs can be incorporated to control the spacing between the connector structures and the printed circuit substrates.

In a first embodiment, the present invention provides an electrical connector structure for use in a separable electrical connector assembly, the electrical connector structure comprising a connector body having a planar array of conductive protrusions and an insulative adhesive layer, the planar array of conductive protrusions being aligned with a planar array of conductive contact pads on a surface of a printed circuit substrate, wherein the adhesive layer is oriented to form a bond between at least a portion of the connector body and the printed circuit substrate, the adhesive layer pressure engaging each of the conductive protrusions with one of the conductive contact pads, thereby electrically coupling each of the conductive protrusions to one of the conductive contact pads.

In a second embodiment, the present invention provides a separable electrical connector assembly comprising a first connector body having a plurality of first conductive contacts, a planar array of first conductive protrusions, and a first adhesive layer, the planar array of first conductive protrusions being aligned with a planar array of first conductive contact pads on a surface of a first printed circuit substrate, wherein the first adhesive layer is oriented to form a first bond between at least a portion of the first connector body and the first printed circuit substrate, the first adhesive layer pressure engaging each of the first conductive protrusions with one of the first conductive contact pads, thereby electrically coupling each of the first conductive protrusions to one of the first conductive contact pads, a second connector body having a plurality of second conductive contacts, a planar array of second conductive protrusions, and a second adhesive layer, the planar array of second conductive protrusions being aligned with a planar array of second conductive contact pads on a surface of a second printed circuit substrate, wherein the second adhesive layer is oriented to form a second bond between at least a portion of the second connector body and the second printed circuit substrate, the second adhesive layer pressure engaging each of the second conductive protrusions with one of the second conductive contact pads, thereby electrically coupling each of the second conductive protrusions to one of the second conductive contact pads, and a third connector body having a plurality of conductive contacts, a planar array of third conductive protrusions and a third adhesive layer, the planar array of third conductive protrusions being aligned with the planar array of second conductive contact pads on the surface of the second printed circuit substrate, wherein the third adhesive layer is oriented to form a third bond between at least a portion of the third connector body and the second printed circuit substrate, the third adhesive layer pressure engaging each of the third conductive protrusions with one of the second conductive contact pads, thereby electrically coupling each of the third conductive protrusions to one of the second conductive contact pads, wherein the second connector body and the third connector body define a socket for separably receiving the first connector body such that at least some of the first conductive contacts are electrically coupled to at least some of the second conductive contacts and the third conductive contacts.

In a third embodiment, the present invention provides an electrical connector structure for use in a separable electrical connector assembly, the electrical connector structure comprising a connector body having a flex circuit and a planar array of conductive protrusions, the flex circuit being attached to the connector body and the planar array of conductive protrusions being formed over the flex circuit, wherein each of the conductive protrusions is metallurgically bonded to one of a planar array of conductive contact pads on a surface of a printed circuit substrate.

In a fourth embodiment, the present invention provides a separable electrical connector assembly comprising a first connector body having a first flex circuit, a plurality of first conductive contacts, and a planar array of first conductive protrusions, the first flex circuit being attached to the first connector body, and the first conductive contacts and the first conductive protrusions being formed over the first flex circuit, wherein each of the first conductive protrusions is metallurgically bonded to one of a planar array of first conductive contact pads on a surface of a first printed circuit substrate, a second connector body having a second flex circuit, a plurality of second conductive contacts, and a planar array of second conductive protrusions, the second flex circuit being attached to the second connector body, and the second conductive contacts and the second conductive protrusions being formed over the second flex circuit, wherein each of the second conductive protrusions is metallurgically bonded to one of a planar array of second conductive contact pads on a surface of a second printed circuit substrate, and a third connector body having a third flex circuit, a plurality of third conductive contacts, and a planar array of third conductive protrusions, the third flex circuit being attached to the third connector body, and the third conductive contacts and the third conductive protrusions being formed over the third flex circuit, wherein each of the third conductive protrusions is metallurgically bonded to one of the planar array of second conductive contact pads on the surface of the second printed circuit substrate, wherein the second connector body and the third connector body define a socket for separably receiving the first connector body such that at least some of the first conductive contacts are electrically coupled to at least some of the second conductive contacts and the third conductive contacts.

In a fifth embodiment, the present invention provides an electrical connector structure for use in a separable electrical connector assembly, the electrical connector structure comprising a connector body having a planar array of conductive protrusions, wherein each of the conductive protrusions is metallurgically bonded to one of a planar array of conductive contact pads on a surface of a printed circuit substrate, the electrical connector structure further comprising means for decoupling the metallurgical bond from at least a portion of stress produced by separation of the connector body from the separable electrical connector assembly and engagement of the connector body with the separable electrical connector assembly.

In a sixth embodiment, the present invention provides a separable electrical connector assembly comprising a first connector body having a plurality of first conductive contacts and a planar array of first conductive protrusions, wherein each of the first conductive protrusions is metallurgically bonded to one of a planar array of first conductive contact pads on a surface of a first printed circuit substrate, a second connector body having a plurality of second conductive contacts and a planar array of second conductive protrusions, wherein each of the second conductive protrusions is metallurgically bonded to one of a planar array of second conductive contact pads on a surface of a second printed circuit substrate, a third connector body having a plurality of third conductive contacts and a planar array of third conductive protrusions, wherein each of the third conductive protrusions is metallurgically bonded to one of the planar array of second conductive contact pads on the surface of the second printed circuit substrate, wherein the second connector body and the third connector body define a socket for separably receiving the first connector body such that at least some of the first conductive contacts are electrically coupled to at least some of the second conductive contacts and the third conductive contacts, the separable electrical connector assembly further comprising means for decoupling the metallurgical bonds from at least a portion of stress produced by disengagement of the first connector body from the socket and engagement of the first connector body with the socket.

In a seventh embodiment, the present invention provides an electrical connector structure for use in a separable electrical connector assembly, the electrical connector structure comprising a connector body having a planar array of conductive protrusions, the planar array of conductive protrusions being aligned with a planar array of conductive contact pads on a surface of a printed circuit substrate, and means for pressure engaging each of the conductive protrusions with one of the conductive contact pads, thereby electrically coupling each of the conductive protrusions to one of said conductive contact pads.

In an eighth embodiment, the present invention provides a separable electrical connector assembly comprising a first connector body having a plurality of first conductive contacts, a planar array of first conductive protrusions, the planar array of first conductive protrusions being aligned with a planar array of first conductive contact pads on a surface of a first printed circuit substrate, and means for pressure engaging each of the first conductive protrusions with one of the first conductive contact pads, thereby electrically coupling each of the first conductive protrusions to one of the first conductive contact pads, a second connector body having a plurality of second conductive contacts, a planar array of second conductive protrusions, the planar array of second conductive protrusions being aligned with a planar array of second conductive contact pads on a surface of a second printed circuit substrate, and means for pressure engaging each of the second conductive protrusions with one of the second conductive contact pads, thereby electrically coupling each of the second conductive protrusions to one of the second conductive contact pads, and a third connector body having a plurality of conductive contacts, a planar array of third conductive protrusions, the planar array of third conductive protrusions being aligned with the planar array of second conductive contact pads on the surface of the second printed circuit substrate, and means for pressure engaging each of the third conductive protrusions with one of the second conductive contact pads, thereby electrically coupling each of the third conductive protrusions to one of the second conductive contact pads, wherein the second connector body and the third connector body define a socket for separably receiving the first connector body such that at least some of the first conductive contacts are electrically coupled to at least some of the second conductive contacts and the third conductive contacts.

Additional features and advantages of the present invention will be set forth in part in the description that follows, and in part will be apparent from the description, or may be learned by practice of the present invention. The advantages of the present invention will be realized and attained by means particularly pointed out in the written description and claims hereof, as well as in the appended drawings.

It is to be understood that both the foregoing general description and the following detailed description are exemplary and explanatory only, and not restrictive of the present invention, as claimed.

BRIEF DESCRIPTION OF THE DRAWINGS

The accompanying drawings are included to provide a further understanding of the present invention and are incorporated in and constitute a part of this specification. The drawings illustrate exemplary embodiments of the present invention and together with the description serve to explain the principles of the invention.

DETAILED DESCRIPTION OF THE PREFERRED EMBODIMENTS

Figure 1:
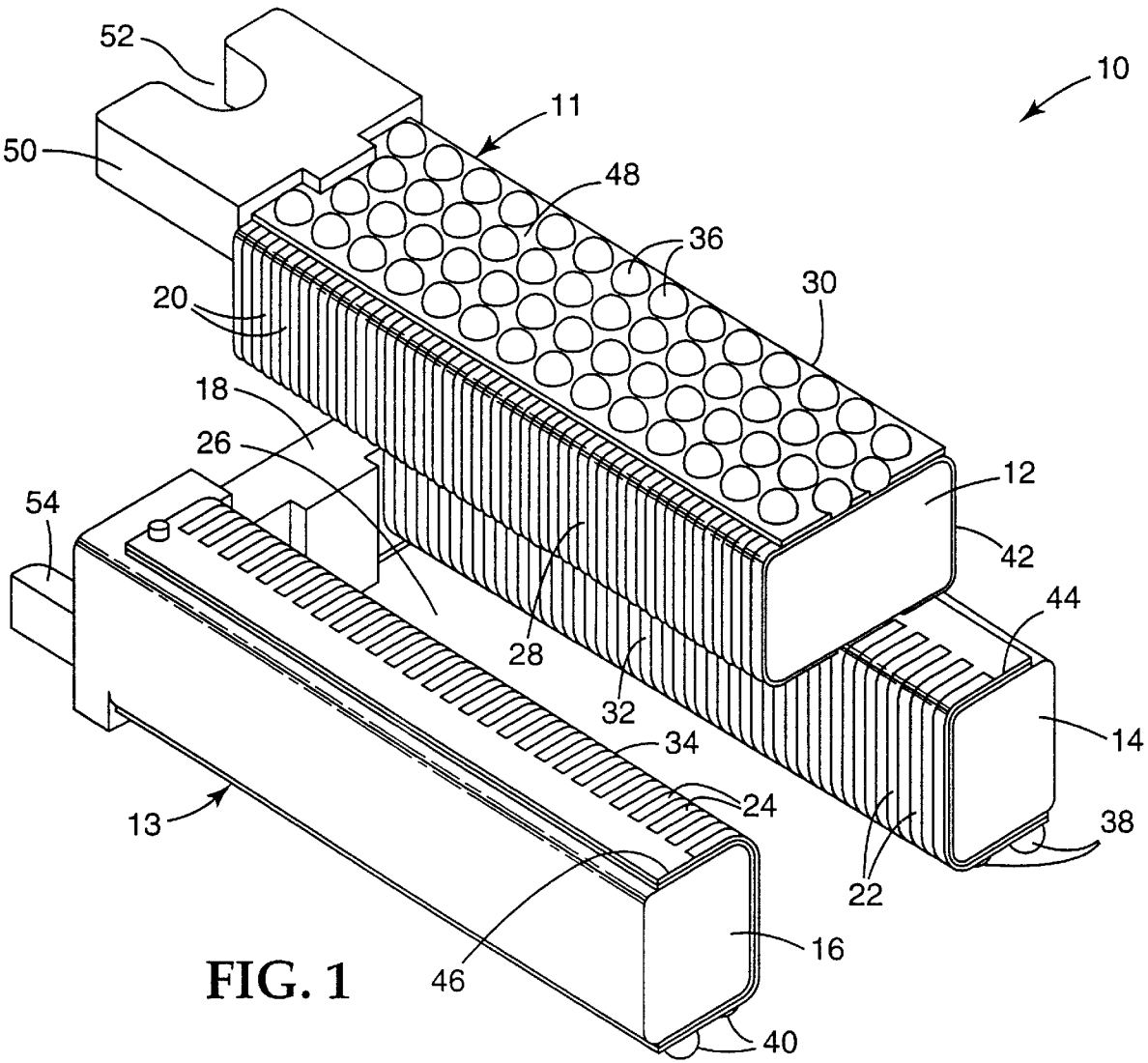
FIG. 1 is a perspective section view of an exemplary embodiment of an electrical connector assembly with a planar array of conductive protrusions formed on at least one connector body in the assembly, in accordance with the present invention.

FIG. 1 is a perspective section view of an exemplary embodiment of an electrical connector assembly 10 having a plurality of conductive protrusions, in accordance with the present invention. As shown in FIG. 1, connector assembly 10 includes a first connector structure 11 and a second connector structure 13. The first connector structure 11 includes a first connector body 12, whereas second connector structure 13 includes both a second connector body 14 and a third connector body 16. The second connector body 14 and third connector body 16 may be joined together by a junction member 18, and may be mounted together on the same printed circuit substrate (not shown in FIG. 1). The junction member 18 may be integrally formed with second and third connector bodies 14, 16 or realized by a separate component coupled between the second and third connector bodies.

The first connector body 12, second connector body 14, and third connector body 16 include a plurality of conductive contacts 20, 22, 24, respectively. The conductive contacts 20 of first connector body 12 are disposed at intervals along both a first exterior side 28 and a second exterior side 30. The conductive contacts 22 of second connector body 14 are disposed at intervals along an interior side 32, whereas conductive contacts 24 of third connector body 16 are disposed at intervals along an interior side 34. The conductive contacts 20, 22, 24 can be formed directly on connector bodies 12, 14, 16 or, as shown in FIG. 1, on flex circuits 42, 44, 46 mounted on the connector bodies. The conductive contacts 20, 22, 24 can be formed by conventional methods such as, for example, photolithography or printing. The spacing between adjacent contacts 20, 22, 24 can be readily controlled with such methods to achieve a desired pitch.

The second connector body 14 and third connector body 16 define a socket 26 for separably receiving first connector body 12 such that at least some of conductive contacts 20 are electrically coupled to at least some of conductive contacts 22 and conductive contacts 24. Specifically, conductive contacts 20 on first connector body 12 are spatially aligned with corresponding contacts 22, 24 on second connector body 14 and third connector body 16. Thus, when first connector body 12 is inserted into socket 26, each of conductive contacts 20 physically engages one of conductive contacts 22, 24, thereby making an electrical interconnection.

FIG. 1 shows connector assembly 10 as making a contact-to-contact interconnection between first connector structure 11 and second connector structure 13 for purposes of example. In accordance with the present invention, however, the interface between first connector structure 11 and second connector structure 13 alternatively could be realized by a variety of different interconnection configurations such as, for example, pin-to-socket or metal plate-to-beam configurations.

With further reference to the exemplary embodiment of FIG. 1, one or more of first, second, and third connector bodies 12, 14, 16 can be formed from a resiliently deformable material. Thus, second connector body 14, third connector body 16, and junction member 18 can be integrally molded from such a material. Examples of a suitable resiliently deformable material for fabrication of connector bodies 12, 14, 16 are silicone or urethane rubber. The socket 26 can be sized to provide an interference fit with second and third connector bodies 14, 16 when first connector body 12 is inserted into the socket. Thus, upon insertion into socket 26, exterior surfaces 28, 30 of first connector body 12 are pressure engaged with interior surface 32 of second connector body 14 and interior surface 34 of third connector body 16 due to the interference forces.

The pressure engagement deforms first, second, and third connector bodies 12, 14, 16, as well as flex circuits 42, 44, 46. In response, the resiliently deformable material produces a force that resists deformation, tending to return the material at least partially to its undeformed state. The conductive contacts 20 of first connector body 12 are aligned with corresponding conductive contacts 22, 24 on second and third connector bodies 14, 16, respectively. The resistive force exerts pressure between conductive contacts 20 conductive contacts 22, 24. As a result, at least some of conductive contacts 20 are electrically coupled to at least some of conductive contacts 22 and conductive contacts 24. In addition, the resistive force causes conductive contacts 20, 22, 24 to exert a wiping force against one another during insertion, thereby removing oxides and contaminants for better electrical contact.

As an alternative to an interference fit, socket 26 could be sized to provide zero insertion force engagement between first connector body 12, second connector body 14, and third connector body 16. In the case of zero insertion force, an external bias member can be provided to bias second connector body 14 and third connector body 16 into the socket toward first connector body 12, thereby exerting pressure on the first connector body. The external bias member could be realized by, for example, a spring-loaded frame.

As further shown in FIG. 1, first connector body 12 includes a planar array of conductive protrusions 36, in accordance with the present invention. The second connector body 14 and third connector body 16 similarly include planar arrays of conductive protrusions 38, 40, respectively. The planar arrays of conductive protrusions 38, 40 are only partially shown in FIG. 1. The planar arrays of conductive protrusions 36, 38, 40 may comprise one-dimensional arrays. For higher interconnection densities, however, two-dimensional arrays of conductive protrusions 36, 38, 40 ordinarily will be desired.

The conductive protrusions 36, 38, 40 could be formed directly on connector bodies 12, 14, 16, respectively. In the exemplary embodiment of FIG. 1, however, conductive protrusions 36 are formed over flex circuit 42 attached to first connector body 12. The conductive protrusions 38, 40 of second connector body 14 and third connector body 16 similarly are formed over flex circuits 44, 46, respectively. Each of flex circuits 42, 44, 46 may comprise a flexible polyimide base over which conductive contacts 20, 22, 24 are formed by methods such as photolithography or printing. The conductive protrusions 36, 38, 40 are formed over portions of conductive contacts 20, 22, 24 on flex circuits 42, 44, 46, respectively, and are electrically coupled to such contacts by metallurgical bonds. An insulating layer 48 may be attached over flex circuit 42 to electrically insulate each of conductive protrusions 36 from one another. The insulating layer 48 may include holes through which conductive protrusions 36 protrude. An insulating layer similar to insulating layer 48 can be provided for conductive protrusions 38, 40 of second connector body 14 and third connector body 16, respectively.

Formation of conductive protrusions 36, 38, 40 on flex circuit 42, 44, 46, respectively, aids in decoupling the conductive protrusions from stresses produced during use of connector assembly 10. The stresses are produced by separation and engagement of connector structure 11 and connector structure 13, as well as by thermal expansion of the different parts of the connector structures. Specifically, separation and engagement of connector structures 11 and 13 produce tension, compression, and torque that can damage or misalign the interface between conductive protrusions 36, 38, 40 and the printed circuit substrates. Differential thermal expansion between connector bodies 12, 14, 16 and the printed circuit substrates creates shear forces that can cause similar problems.

Each of conductive protrusions 36, 38, 40 can be metallurgically bonded or pressure engaged with one of a planar array of conductive contact pads on a surface of a printed circuit substrate (not shown in FIG. 1), thereby making a plurality of electrical interconnections. The printed circuit substrate may comprise, for example, a printed circuit board or a flex circuit. The conductive protrusions 36, 38, 40 may be realized by a variety of different materials suitable for either formation of a metallurgical bond or pressure engagement. For example, conductive protrusions 36, 38, 40 may comprise metal bumps such as copper, gold, silver, palladium, or tin bumps suitable for pressure engagement, or heat fusible metal balls such as tin-lead solder balls for making a metallurgical bond, or a combination of both. The conductive protrusions 36, 38, 40 can be formed over flex circuits 42, 44, 46 by a variety of techniques such as, for example, stenciling, direct deposition of molten metal, casting, or plating.

For direct metallurgical bonding to contact pads on printed circuit substrates, conductive protrusions 36, 38, 40 may take the form of an array of solder balls. The solder balls can be thermally reflowed to wet conductive contact pads on the surface of a printed circuit substrate. The solder reflow process results in a mechanical, as well as electrical, bond with the contact pads. The size, geometry, and amount of the solder balls can be carefully controlled and visually inspected prior to reflow to ensure uniform alignment of the solder balls with the contact pads. In particular, the solder balls will tend to self align with the contact pads if they are located such that connector bodies 12, 14, 16 are allowed to "float" during the solder reflow process due to the surface tensions of the solder balls. The "float" phenomenon typically will require good surface planarity of both connector bodies 12, 14, 16 and the printed circuit substrates to which they are coupled. In addition, the weights of connector bodies 12, 14, 16 should be controlled to avoid collapse of the molten solder balls during reflow. Further, the centers of gravity of connector bodies 12, 14, 16 should be located so as to avoid significant tilting of the connector bodies during reflow.

As an alternative to direct metallurgical bonding with solder balls, conductive protrusions 36, 38, 40 may comprise metal bumps that are metallurgically bonded to the contact pads. In this case, the metal bumps may comprise, for example, copper, gold, silver, palladium, or tin bumps. The metal bumps, the contact pads, or both may carry a heat-fusible metal such as solder for metallurgical bonding by reflow. If conductive protrusions 36, 38, 40 are made of metal that is not heat fused, the considerations discussed above concerning planarity, connector body weight, and centers of gravity are less significant. Rather, the metal bumps will tend to act as spacing elements that control the distance between connector bodies 12, 14, 16 and the printed circuit substrates over which they are mounted.

As an alternative to metallurgical bonding, conductive protrusions 36, 38, 40 can be pressure engaged with the contact pads. For pressure engagement, conductive protrusions 36, 38, 40 preferably are metal bumps such as, for example, copper, gold, silver, palladium, or tin bumps. The pressure engagement can be achieved by a variety of mechanisms. For example, a mechanical fastening member can be provided to force each connector body 12, 14, 16 toward the printed circuit substrate on which it is mounted. As one illustration, in FIG. 1, first connector structure 11 includes a bracket 50 with a screw hole 52. A screw may be inserted through screw hole 52 and into a screw hole on the printed circuit substrate on which first connector structure 11 is mounted. The screw then can be tightened to pressure engage conductive protrusions 36 to conductive pads on the surface of the printed circuit substrate. For pressure uniformity, first connector structure 11 may include a second bracket (not shown) on an opposite end of connector body 12. The second connector structure 13 may include one or more similar screw brackets. FIG. 1 provides a partial view of one screw bracket 54.

Pressure engagement of conductive protrusions 36, 38, 40 with the conductive contact pads on the printed circuit substrates alternatively can be achieved by adhesively bonding the respective connector bodies 12, 14, 16 to the printed circuit substrates with thermoplastic, heat-curable, or UV-curable adhesive layers. Suitable thermoplastic adhesive materials may include, for example, hot-melt adhesives. Suitable heat-curable adhesive materials may include, for example, epoxy. Suitable UV-curable adhesive materials may include, for example, acrylics. With reference to connector body 12, an insulative adhesive layer can be formed over conductive protrusions 36. After mounting connector body 12 on a printed circuit substrate, and aligning conductive protrusions 36 with respective contact pads, the adhesive layer can be heat-bonded, heat-cured, or UV-cured, depending on the particular adhesive material selected. The adhesive layer can be selected such that, upon heat bonding, heat-curing, UV-curing, or subsequent cool-down, the adhesive layer contracts or at least retains the pressure applied to it during bonding or curing. The contraction or pressure retention serves to forcibly draw conductive protrusions 36 toward the contact pads on the printed circuit substrate. The force of the contraction produces pressure engagement between the conductive protrusions and the contact pads, providing both sufficient electrical coupling pressure and mechanical stability. The use of an adhesive layer to pressure-engage conductive protrusions 36, 38, 40 with respective contact pads will be discussed again later in this description.

Figure 2:
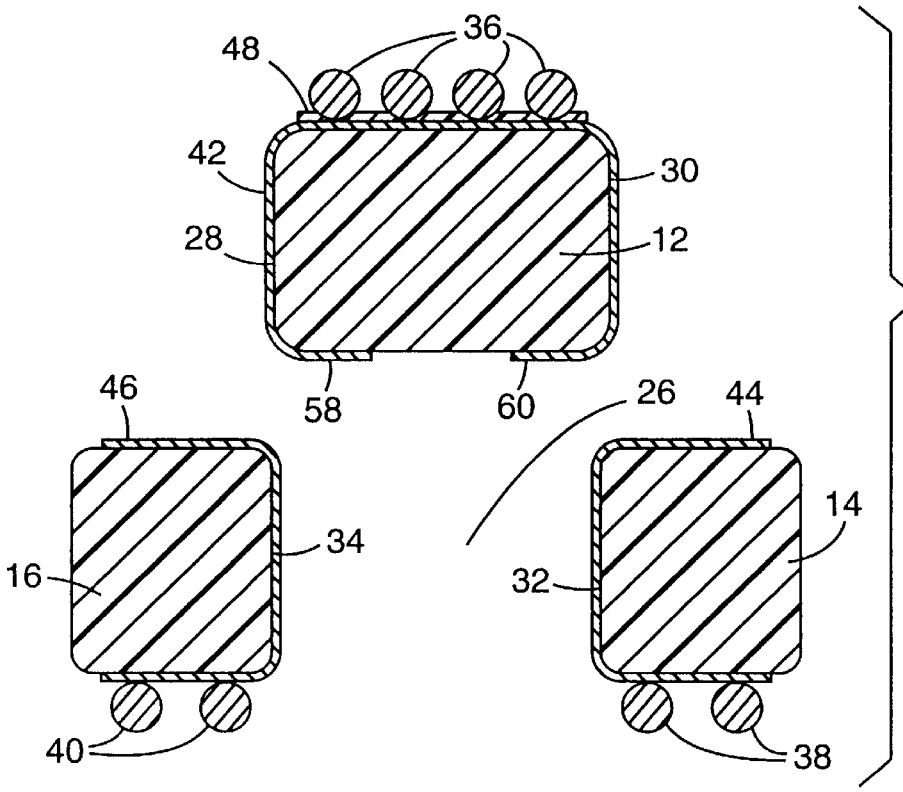
FIG. 2 is a cross-sectional end view of the electrical connector assembly of FIG. 1, in accordance with the present invention.

FIG. 2 is a cross-sectional end view of electrical connector assembly 10 of FIG. 1, in accordance with the present invention. As shown in FIG. 2, flex circuit 42 is wrapped around the exterior of connector body 12 and includes two end portions 58, 60. Flex circuits 44, 46 similarly are wrapped around the exteriors of connector bodies 14, 16, respectively. Conductive protrusions 36, 38, 40, in the form of either metal bumps, metal bumps carrying a heat-fusible metal, or heat-fusible metal balls such as solder balls, are formed on flex circuits 42, 44, 46, respectively. The flex circuit 42 can be adhesively mounted on connector body 12. Flex circuits 44, 46 can be mounted on the exteriors of connector bodies 14, 16, respectively, in a similar manner using such an adhesive.

Figure 3:
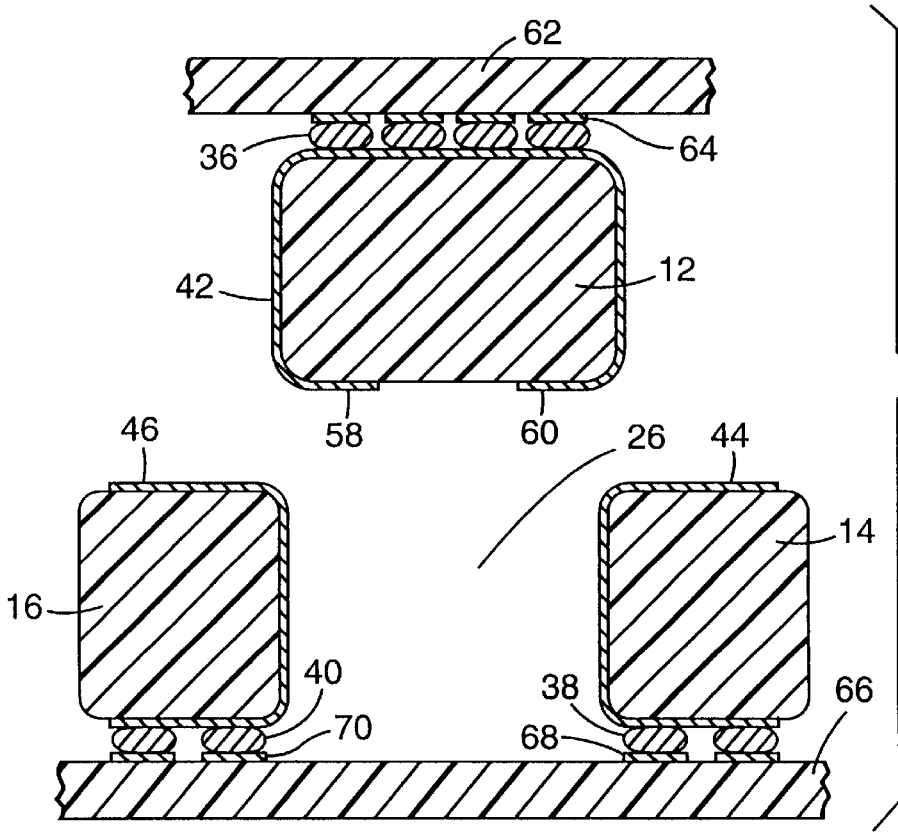
FIG. 3 is a cross-sectional end view of the electrical connector assembly of FIG. 1 coupled to printed circuit boards via heat-fusible metallurgical bonds, in accordance with the present invention.

FIG. 3 is a cross-sectional end view of the electrical connector assembly 10 of FIG. 1 coupled to printed circuit boards via metallurgical bonds, in accordance with the present invention. In particular, FIG. 3 shows conductive protrusions 36 of first connector body 12 in the form of solder balls coupled to a printed circuit board 62 via metallurgical bonds with contact pads 64. FIG. 3 also shows conductive protrusions 38 of second connector body 14 and conductive protrusions 40 of third connector body 16 in the form of solder balls coupled to printed circuit board 66 via metallurgical bonds with conductive pads 68 and 70, respectively. The conductive protrusions 36, 38, 40 are shown in FIG. 3 in a partially collapsed condition produced by flow of the molten solder due to connector weight, applied pressure, and/or wetting during the solder reflow process.

Figure 4:
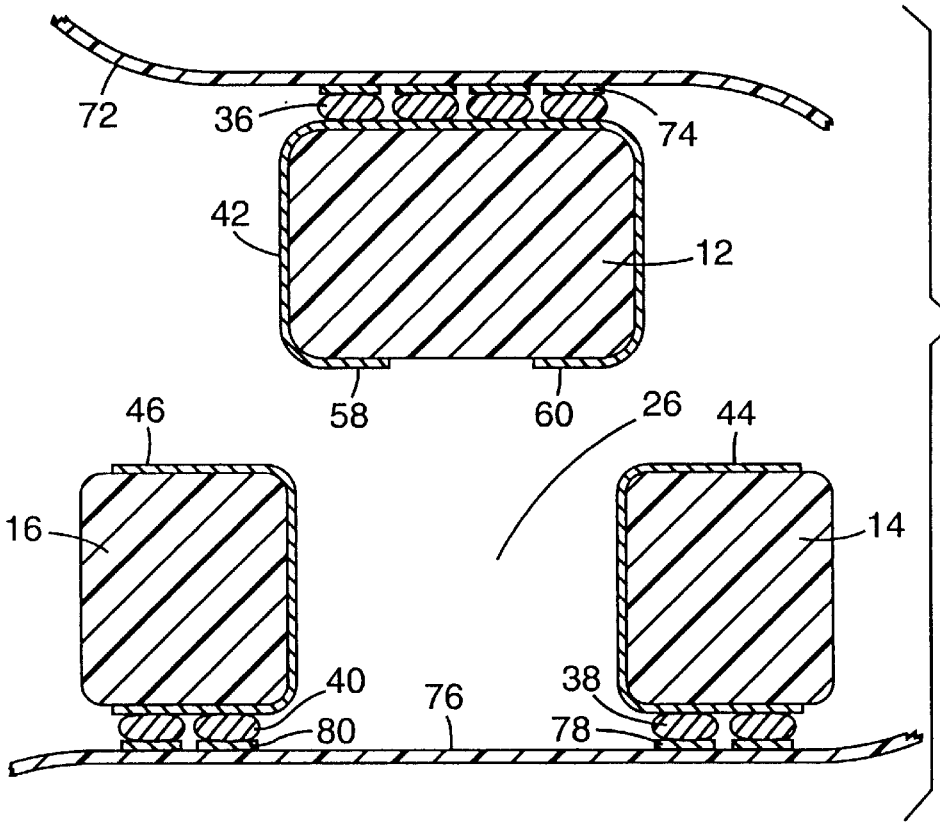
FIG. 4 is a cross-sectional end view of the electrical connector assembly of FIG. 1 coupled to flex circuits via heat-fusible metallurgical bonds, in accordance with the present invention.

FIG. 4 is a cross-sectional end view of electrical connector assembly 10 of FIG. 1 coupled to flex circuits via metallurgical bonds, in accordance with the present invention. In particular, FIG. 4 shows conductive protrusions 36 of first connector body 12 in the form of solder balls coupled to a flex circuit 72 via metallurgical bonds with contact pads 74. FIG. 3 also shows conductive protrusions 38 of second connector body 14 and conductive protrusions 40 of third connector body 16 in the form of solder balls coupled to flex circuit 76 via heat-fusible metallurgical bonds with conductive pads 78 and 80, respectively. As in the example of FIG. 3, conductive protrusions 36, 38, 40 are shown in FIG. 3 in a partially collapsed condition produced by the solder reflow process.

The metallurgical bonds between conductive protrusions 36, 38, 40 and the conductive pads shown in FIGS. 3 and 4 can be subjected to a significant amount of stress due to both engagement of first connector body 12 with socket 26 and separation of the first connector body from the socket during use. In addition, thermal expansion between first connector body 12 and printed circuit board 62 and between second connector body 14, third connector body 16, and printed circuit board 66 can produce stress on the metallurgical bonds. For example, differential thermal expansion may produce shear stresses in connector bodies 12, 14, 16 and/or the printed circuit substrates. Use of connector assembly 10 can produce tension, compression, and torque. The resulting stresses can cause breakage of both the mechanical connection and electrical connection provided by each metallurgical bond, rendering the overall connector assembly 10 unusable in extreme cases. Thermal expansion also may exist when connector bodies 12, 14, 16 are coupled to flex circuits. In accordance with the present invention, flex circuits 42, 44, 46, which carry conductive protrusions 36, 38, 40, respectively, act as partial decoupling mechanisms. Specifically, the flexibility and resilience of the polyimide base of each of flex circuits 42, 44, 46 serve to absorb at least a portion of the stresses produced by connector engagement and separation and differential thermal expansion, thereby partially decoupling the metallurgical bonds from that portion of such stresses.

Figure 5:
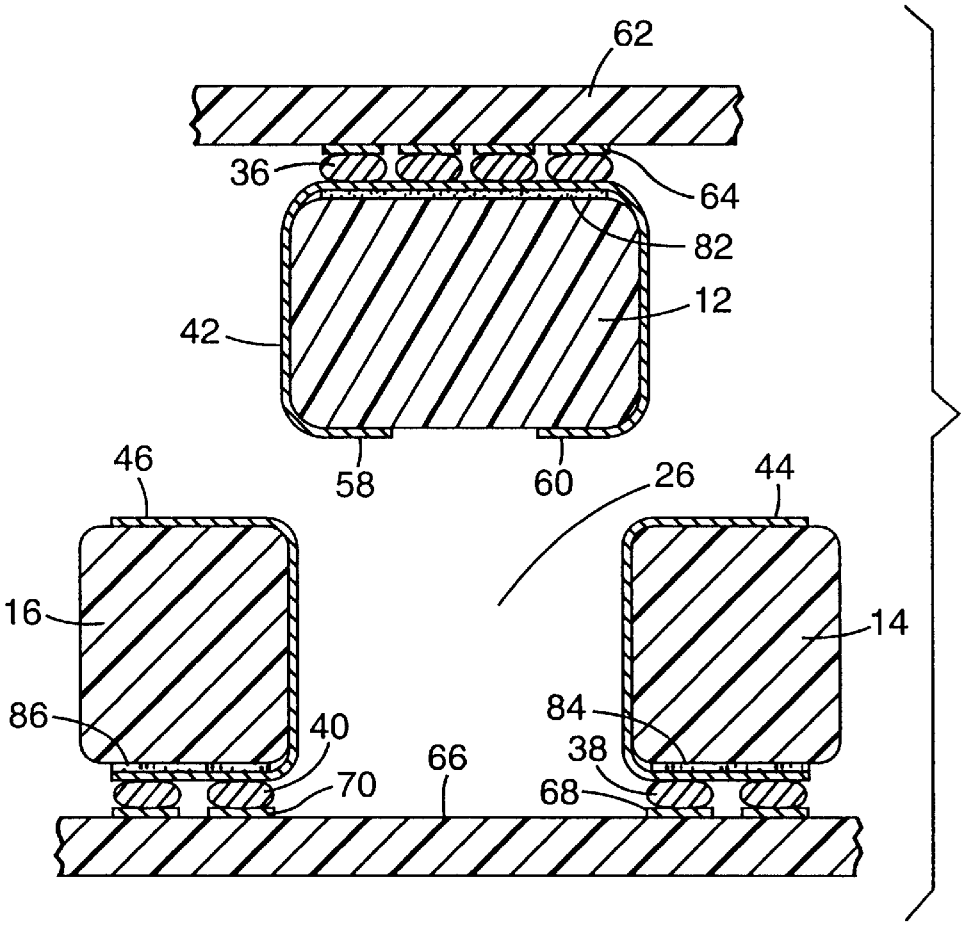
FIG. 5 is a cross-sectional end view of the electrical connector assembly of FIG. 1 further incorporating a compliant backing layer and coupled to printed circuit boards via heat-fusible metallurgical bonds, in accordance with the present invention.

FIG. 5 is a cross-sectional end view of electrical connector assembly 10 of FIG. 1 further incorporating a compliant backing layer and coupled to printed circuit boards via metallurgical bonds, in accordance with the present invention. Specifically, in FIG. 5, first connector body 12 includes a compliant backing layer 82 disposed between flex circuit 42 and the exterior of the connector body adjacent conductive protrusions 36, second connector body 14 includes a compliant backing layer 84 disposed between flex circuit 44 and the exterior of the connector body adjacent conductive protrusions 38, and third connector body 16 includes a compliant backing layer 86 disposed between flex circuit 46 and the exterior of the connector body adjacent conductive protrusions 40. Although FIG. 5 shows connector bodies 12, 14, 16 coupled to printed circuit boards 62, 66, compliant backing layers 82, 84, 86 can be readily used with connector bodies coupled to flex circuits, as in the example of FIG. 4.

The compliant backing layers 82, 84, 86 can be adhesively bonded to both the respective connector bodies and the respective flex circuits between which they are disposed. The compliant backing layers 82, 84, 86 act in combination with flex circuits 42, 44, 46 to further decouple the metallurgical bonds between conductive protrusions 36, 38, 40 and contact pads 64, 68, 70, respectively, from stresses caused by engagement and separation of first connector body 12 with and from socket 26 and by thermal expansion. The compliant backing layers 82, 84, 86 provide additional control of the spacing between printed circuit boards 62, 66 and connector bodies 12, 14, 16. In addition, compliant backing layers 82, 84, 86 accommodate slight stretching or compression that may occur in flex circuits 42, 44, 46 due to differential thermal expansion between printed circuit boards 62, 66 and connector bodies 12, 14, 16. The compliant backing layers 82, 84, 86 also improve co-planarity between conductive protrusions 36, 38, 40 and contact pads 64, 68, 70 on printed circuit boards 62, 66.

Figure 6:
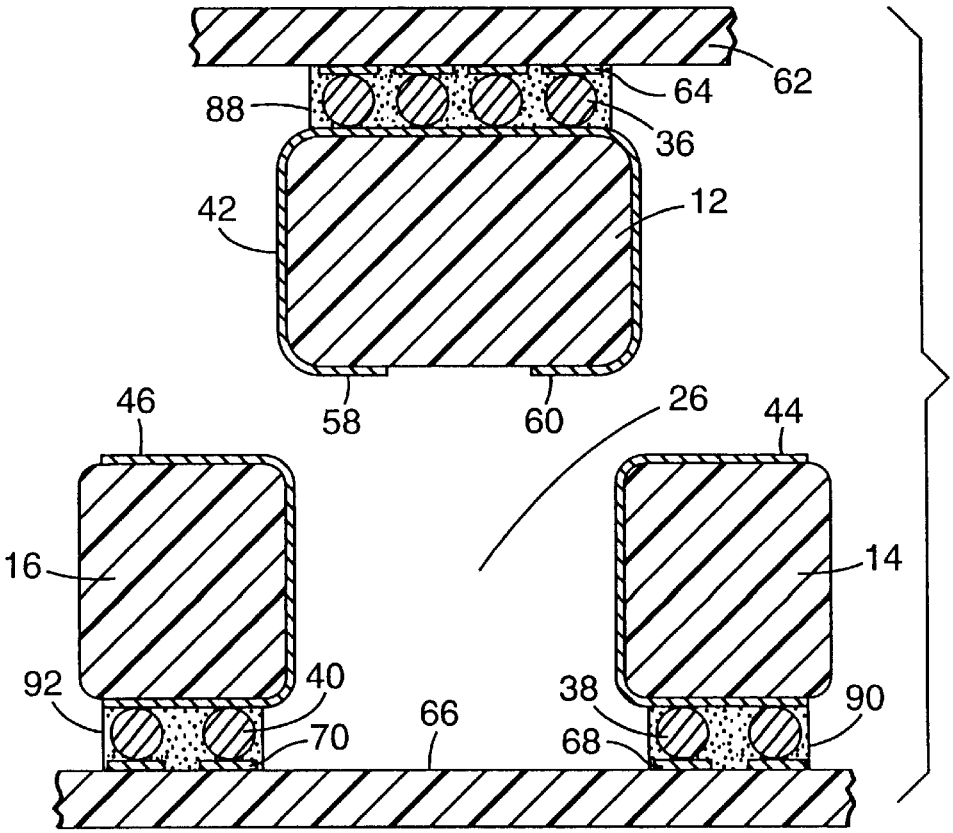
FIG. 6 is a cross-sectional end view of the electrical connector assembly of FIG. 1 coupled to printed circuit boards via insulative adhesive bonds, in accordance with the present invention.

FIG. 6 is a cross-sectional end view of the electrical connector assembly of FIG. 1 coupled to printed circuit boards via insulative adhesive bonds, in accordance with the present invention. As shown in FIG. 6, a first adhesive layer 88 is formed between first connector body 12 and printed circuit board 62, a second adhesive layer 90 is formed between second connector body 14 and printed circuit board 66, and a third adhesive layer 92 is formed between third connector body 16 and printed circuit board 66. Although FIG. 6 shows connector bodies 12, 14, 16 coupled to printed circuit boards 62, 66, adhesive layers 88, 90, 92 can be readily used with connector bodies coupled to flex circuits, as in the example of FIG. 4. Each of adhesive layers 88, 90, 92 is oriented to form an insulative adhesive bond between at least a portion of the respective connector body 12, 14, 16 and the respective printed circuit board 62, 66. The adhesive layers 88, 90, 92 can be applied to fill the gaps between adjacent conductive protrusions. Thus, adhesive layers 88, 90, 92 also may serve to electrically insulate the conductive protrusions on each connector body 12, 14, 16 from one another. When metal bumps are used to form conductive protrusions 36, 38, 40, adhesive layers 88, 90, 92 should be applied to a thickness approximately equal to the height of the protrusions.

Each of adhesive layers 88, 90, 92 preferably is heat-bondable, heat-curable, or UV-curable to pressure engage each of conductive protrusions 36, 38, 40 with one of conductive contact pads 64, 68, 70, thereby electrically coupling each of the conductive protrusions to one of the conductive contact pads. Each of adhesive layers 88, 90, 92 may comprise, for example, a thermoplastic, heat-curable, or UV-curable adhesive material. Upon thermal bonding, thermal curing, UV-curing, or subsequent cool-down, the adhesive layers 88, 90, 92 preferably develop added strength and contract to draw conductive protrusions 36, 38, 40 toward contact pads 64, 68, 70, as discussed earlier in this description with reference to FIG. 1. The force of the contraction produces pressure engagement between conductive protrusions 36, 38, 40 and contact pads 64, 68, 70.

The adhesive layers 88, 90, 92 provide not only sufficient electrical coupling pressure, but also mechanical stability. In particular, adhesive layers 88, 90, 92 serve to further decouple the pressure engagement of conductive protrusions 36, 38, 40 and contact pads 64, 68, 70 from stresses caused by engagement and separation of first connector body 12 with and from socket 26, and stresses caused by differential thermal expansion. With pressure engagement of conductive protrusions 36, 38, 40 with contact pads 64, 68, 70, there are no mechanical bonds that can be broken by such stresses. However, the pressure engaged protrusions 36, 38, 40 and pads 64, 68, 70 nevertheless may be subject to misalignment or separation due to separation and engagement of the connector structures or differential thermal expansion. The adhesive layers 88, 90, 92 can be selected to provide added compliance that absorbs much of the stress, thereby maintaining pressure engagement for sufficient electrical coupling pressure.

Figure 7:
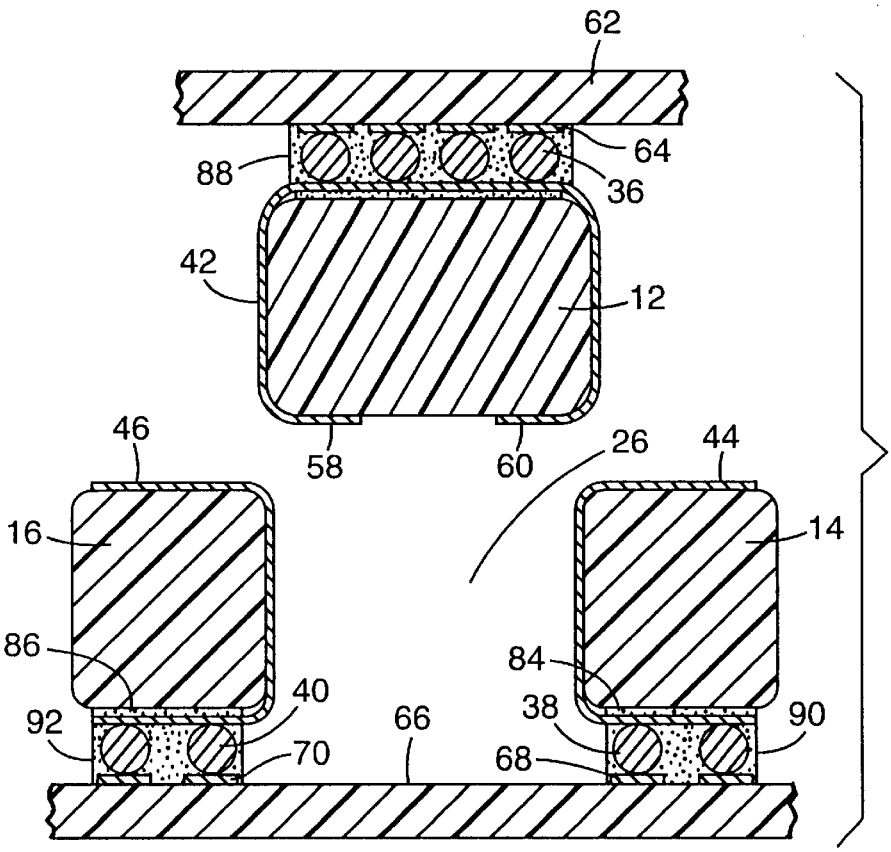
FIG. 7 is a cross-sectional end view of the electrical connector assembly of FIG. 1 further incorporating a compliant backing layer and coupled to printed circuit boards via insulative adhesive bonds, in accordance with the present invention.

FIG. 7 is a cross-sectional end view of electrical connector assembly 10 of FIG. 1 further incorporating a compliant backing layer and coupled to printed circuit boards via adhesive bonds, in accordance with the present invention. Specifically, FIG. 7 shows a first compliant backing layer 82 disposed between first connector body 12 and flex circuit 42 adjacent conductive protrusions 36, a second compliant backing layer 84 disposed between first connector body 14 and flex circuit 44 adjacent conductive protrusions 38, and a third compliant backing layer 86 disposed between first connector body 16 and flex circuit 46 adjacent conductive protrusions 40. In addition, FIG. 7 shows a first adhesive layer 88 formed between first connector body 12 and printed circuit board 62, a second adhesive layer 90 formed between second connector body 14 and printed circuit board 66, and a third adhesive layer 92 formed between third connector body 16 and printed circuit board 66.

As in the example of FIG. 6, adhesive layers 88, 90, 92 shown in FIG. 7 are selected to pressure engage conductive protrusions 36, 38, 40 with contact pads 64, 68, 70 via contraction upon thermal bonding, thermal curing, or UV-curing. In addition, the combination of compliant backing layers 82, 84, 86 and adhesive layers 88, 90, 92, together with flex circuits 42, 44, 46, serves to more effectively decouple stresses produced by engagement and separation of first connector body 12 with and from socket 48 and stresses produced by thermal expansion. Although FIG. 7 shows connector bodies 12, 14, 16 coupled to printed circuit boards 62, 66, compliant backing layers 82, 84, 86 and adhesive layers 88, 90, 92 can be readily used with connector bodies coupled to flex circuits, as in the example of FIG. 4.

Figure 8:
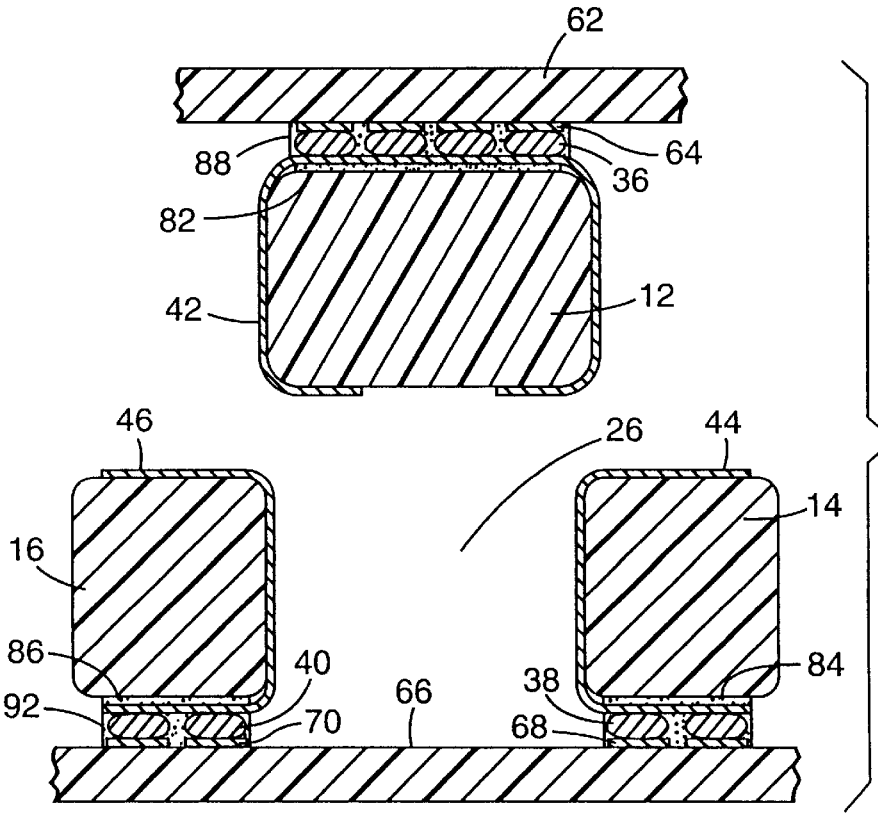
FIG. 8 is a cross-sectional end view of the electrical connector assembly of FIG. 1 further incorporating a compliant backing layer and an insulative adhesive layer and coupled to printed circuit boards via heat-fusible metallurgical bonds, in accordance with the present invention.

FIG. 8 is a cross-sectional end view of electrical connector assembly 10 of FIG. 1 further incorporating a compliant backing layer and an insulative adhesive layer and coupled to printed circuit boards via metallurgical bonds, in accordance with the present invention. Like FIG. 7, FIG. 8 shows a first compliant backing layer 82 disposed between first connector body 12 and flex circuit 42 adjacent conductive protrusions 36, a second compliant backing layer 84 disposed between first connector body 14 and flex circuit 44 adjacent conductive protrusions 38, and a third compliant backing layer 86 disposed between first connector body 16 and flex circuit 46 adjacent conductive protrusions 40. Also like FIG. 7, FIG. 8 shows a first adhesive layer 88 formed between first connector body 12 and printed circuit board 62, a second adhesive layer 90 formed between second connector body 14 and printed circuit board 66, and a third adhesive layer 92 formed between third connector body 16 and printed circuit board 66. Unlike FIG. 7, however, conductive protrusions 36, 38, 40 are shown as solder balls in a partially collapsed state subsequent to thermal reflow to form metallurgical bonds with conductive contact pads 64, 68, 70.

In the example of FIG. 8, the solder of conductive protrusions 36, 38, 40 provides both electrical and mechanical coupling. Thus, adhesive layers 88, 90, 92 need not be provided for the purpose of pressure engagement between conductive protrusions 36, 38, 40 and contact pads 64, 68, 70, as in the example of FIG. 7. Nevertheless, incorporation of adhesive layers 88, 90, 92 may be desirable to decouple stresses, in combination with compliant backing layers 82, 84, 86 and flex circuits 42, 44, 46, that otherwise could break the solder interconnections. It may be desirable to apply adhesive layers 88, 90, 92 with a thickness slightly less than the height of conductive protrusions 36, 38, 40 when solder balls are used. In this manner, the solder balls are allowed to wet contact pads 64, 68, 70 and partially collapse prior to formation of the adhesive bond. Again, although FIG. 8 shows connector bodies 12, 14, 16 coupled to printed circuit boards 62, 66, compliant backing layers 82, 84, 86 and adhesive layers 88, 90, 92 can be readily used with connector bodies coupled to flex circuits, as in the example of FIG. 4.

Figure 9:
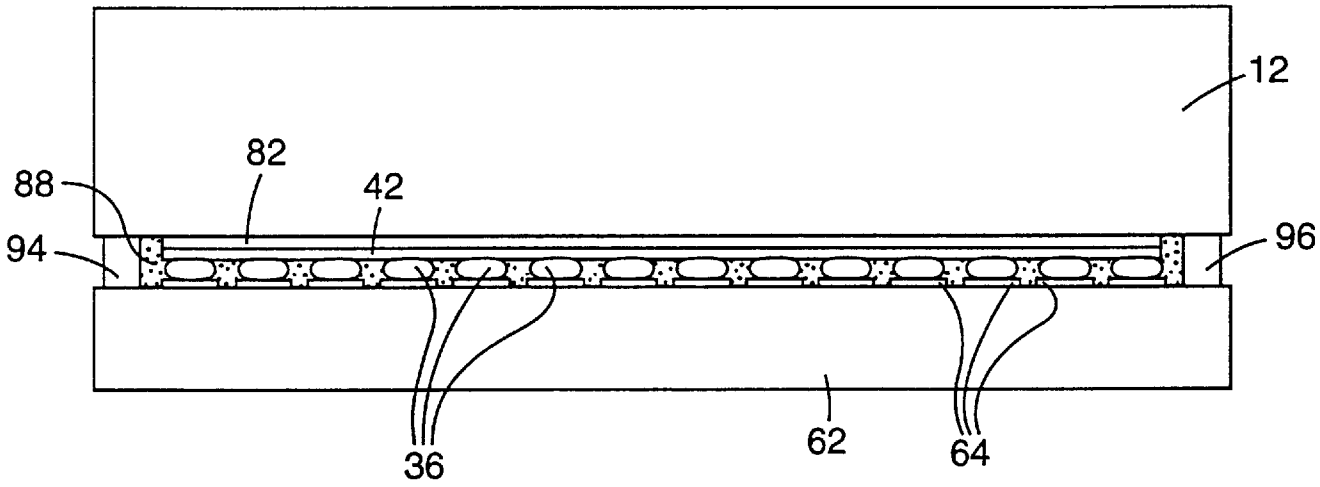
FIG. 9 is a side view of a portion of the electrical connector assembly of FIG. 1 further incorporating a compliant backing layer, an insulative adhesive layer, and standoffs, and coupled to a printed circuit board via heat-fusible metallurgical bonds, in accordance with the present invention.

FIG. 9 is a side view of a portion of electrical connector assembly 10 of FIG. 1 further incorporating a compliant backing layer, an insulative adhesive layer, and standoffs, and coupled to a printed circuit board via metallurgical bonds, in accordance with the present invention. Specifically, FIG. 9 shows first connector body 12 with compliant backing layer 82 disposed between the connector body and flex circuit 42, adhesive layer 88 forming a bond between the connector body and printed circuit board 62, and standoffs 94, 96 disposed between the connector body and the printed circuit board. FIG. 9 shows conductive protrusions 36 as solder balls in a partially collapsed state subsequent to thermal reflow to form metallurgical bonds with conductive contact pads 64. As in the example of FIG. 8, flex circuit 42, compliant backing layer 82, and adhesive layer 88 act to substantially decouple the metallurgical bonds from stresses. The example of FIG. 9 can be readily modified to mount connector body 12 over a flex circuit.

The standoffs 94, 96 serve to control the spacing between connector body 12 and printed circuit board 62, and also can be incorporated with connector bodies 14, 16 to control spacing relative to printed circuit board 66. Thus, standoffs 94, 96 serve to further decouple the metallurgical bonds from stresses caused by engagement of first connector body 12 with socket 26 and thermal expansion. The standoffs 94, 96 need not be bonded to the printed circuit substrate. The standoffs 94, 96 may also serve to decouple the metallurgical bonds from stresses caused by separation of first connector body from socket 26, however, if the standoffs are bonded to the printed circuit substrate. The standoffs 94, 96 can be integrally molded into connector body 12 or provided as metal or plastic parts inserted in the connector body during assembly. As a further variation, standoffs 94, 96 may be configured to mate with holes in printed circuit board 62. The holes in the printed circuit board can thereby provide alignment and retention for connector body 12 relative to contact pads 64. Further, mechanical connection of standoffs 94, 96 to the holes can further decouple the metallurgical bonds between conductive protrusions 36 and contact pads 64 from stresses.

Figure 10:
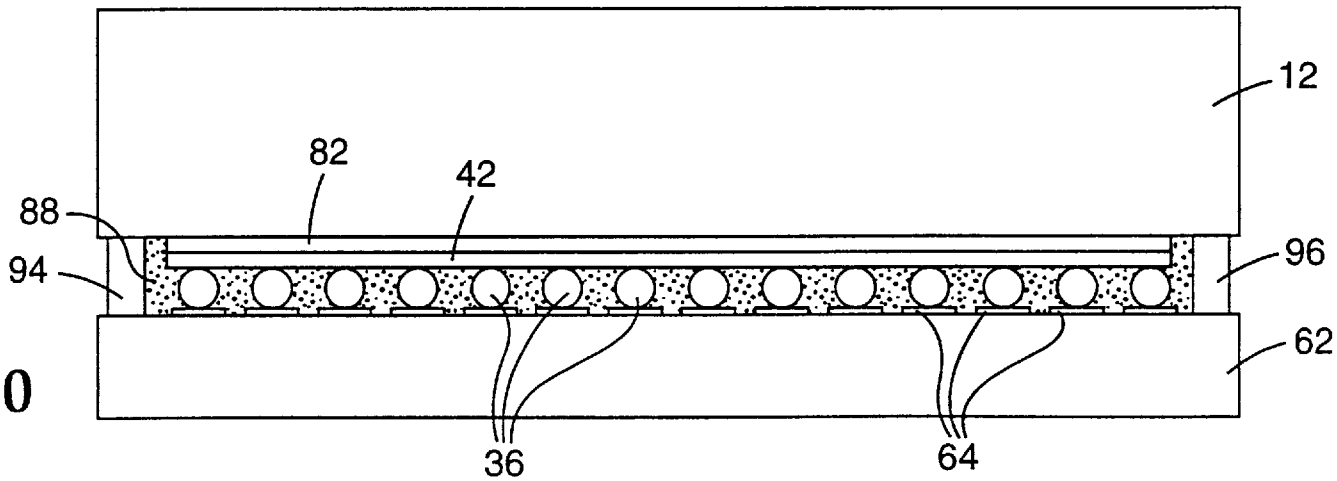
FIG. 10 is a side view of a portion of the electrical connector assembly of FIG. 1 further incorporating a compliant backing layer, an insulative adhesive layer, and standoffs, and coupled to a printed circuit board via adhesive bonds, in accordance with the present invention.

FIG. 10 is a side view of a portion of the electrical connector assembly of FIG. 1 further incorporating a compliant backing layer, an insulative adhesive layer, and standoffs, and coupled to printed circuit boards via adhesive bonds, in accordance with the present invention. FIG. 10 substantially corresponds to FIG. 9, but illustrates the use of adhesive bonds to provide pressure engagement between conductive protrusions 36 and contact pads 64. Specifically, FIG. 10 shows first connector body 12 with compliant backing layer 82 disposed between the connector body and flex circuit 42, adhesive layer 88 forming a bond between the connector body and printed circuit board 62, and standoffs 94, 96 disposed between the connector body and the printed circuit board. FIG. 10 shows conductive protrusions 36, 38, 40 as metal bumps that are pressure engaged with contact pads 64 by forces generated by contraction of adhesive layer 88. The example of FIG. 10 can be readily modified for mounting of connector body 12 over a flex circuit. In the examples of FIGS. 9 and 10, standoffs 94, 96 are shown at the outside periphery of the contact area made by conductive protrusions 36 and contact pads 64. For added stability and decoupling, however, it may be desirable to include additional standoffs at positions within the contact area.

Having described the exemplary embodiments of the invention, additional advantages and modifications will readily occur to those skilled in the art from consideration of the specification and practice of the invention disclosed herein. Therefore, the specification and examples should be considered exemplary only, with the true scope and spirit of the invention being indicated by the following claims.

What is claimed is:

1. A separable electrical connector assembly comprising:

a first connector body having a plurality of first conductive contacts, a planar array of first conductive protrusions, and a first adhesive layer, said planar array of first conductive protrusions being aligned with a planar array of first conductive contact pads on a surface of a first printed circuit substrate, wherein said first adhesive layer is oriented to form a first bond between at least a portion of said first connector body and said first printed circuit substrate, said first adhesive layer pressure engaging each of said first conductive protrusions with one of said first conductive contact pads, thereby electrically coupling each of said first conductive protrusions to one of said first conductive contact pads;

a second connector body having a plurality of second conductive contacts, a planar array of second conductive protrusions, and a second adhesive layer, said planar array of second conductive protrusions being aligned with a planar array of second conductive contact pads on a surface of a second printed circuit substrate, wherein said second adhesive layer is oriented to form a second bond between at least a portion of said second connector body and said second printed circuit substrate, said second adhesive layer pressure engaging each of said second conductive protrusions with one of said second conductive contact pads, thereby electrically coupling each of said second conductive protrusions to one of said second conductive contact pads; and a third connector body having a plurality of conductive contacts, a planar array of third conductive protrusions and a third adhesive layer, said planar array of third conductive protrusions being aligned with said planar array of second conductive contact pads on said surface of said second printed circuit substrate, wherein said third adhesive layer is oriented to form a third bond between at least a portion of said third connector body and said second printed circuit substrate, said third adhesive layer pressure engaging each of said third conductive protrusions with one of said second conductive contact pads, thereby electrically coupling each of said third conductive protrusions to one of said second conductive contact pads, wherein said second connector body and said third connector body define a socket for separably receiving said first connector body such that at least some of said first conductive contacts are electrically coupled to at least some of said second conductive contacts and said third conductive contacts.

2. The separable electrical connector assembly of claim 1, wherein each of said first conductive protrusions, said second conductive protrusions, and said third conductive protrusions comprises a conductive bump.

3. The separable electrical connector assembly of claim 1, wherein each of said first conductive protrusions, said second conductive protrusions, and said third conductive protrusions comprises one of the group consisting of copper, gold, silver, palladium, tin, and solder.

4. The separable electrical connector assembly of claim 1, further including means for decoupling said first bond, said second bond, and said third bond from at least a portion of stress produced by disengagement of said first connector body from said socket and engagement of said first connector body with said socket and at least a portion of stress caused by thermal expansion between said first connector body and said first printed circuit substrate and between said second connector body, said third connector body, and said second printed circuit substrate.

5. The separable electrical connector assembly of claim 4, wherein the decoupling means includes a first flex circuit attached to said first connector body, said first conductive protrusions being formed over said first flex circuit, a second flex circuit attached to said second connector body, said second conductive protrusions being formed over said second flex circuit, and a third flex circuit attached to said third connector body, said third conductive protrusions being formed over said third flex circuit.

6. The separable electrical connector assembly of claim 5, wherein the decoupling means further includes a first compliant layer disposed between said first connector body and said first flex circuit, a second compliant layer disposed between said second connector body and said second flex circuit, and a third compliant layer disposed between said third connector body and said third flex circuit.

7. The separable electrical connector assembly of claim 4, wherein the decoupling means includes one or more first standoffs coupled between said first connector body and said first printed circuit substrate, one or more second standoffs coupled between said second connector body and said second printed circuit substrate, and one or more third standoffs coupled between said third connector body and said second printed circuit substrate.

8. The separable electrical connector assembly of claim 1, wherein at least one of said first printed circuit substrate and said second printed circuit substrate is a printed circuit board.

9. The separable electrical connector assembly of claim 1, wherein at least one of said first printed circuit substrate and said second printed circuit substrate is a flex circuit.

10. A separable electrical connector assembly comprising:

a first connector body having a first flex circuit, a plurality of first conductive contacts, and a planar array of first conductive protrusions, said first flex circuit being attached to said first connector body, and said first conductive contacts and said first conductive protrusions being formed over said first flex circuit, wherein each of said first conductive protrusions is metallurgically bonded to one of a planar array of first conductive contact pads on a surface of a first printed circuit substrate;

a second connector body having a second flex circuit, a plurality of second conductive contacts, and a planar array of second conductive protrusions, said second flex circuit being attached to said second connector body, and said second conductive contacts and said second conductive protrusions being formed over said second flex circuit, wherein each of said second conductive protrusions is metallurgically bonded to one of a planar array of second conductive contact pads on a surface of a second printed circuit substrate; and a third connector body having a third flex circuit, a plurality of third conductive contacts, and a planar array of third conductive protrusions, said third flex circuit being attached to said third connector body, and said third conductive contacts and said third conductive protrusions being formed over said third flex circuit, wherein each of said third conductive protrusions is metallurgically bonded to one of said planar array of second conductive contact pads on said surface of said second printed circuit substrate, wherein said second connector body and said third connector body define a socket for separably receiving said first connector body such that at least some of said first conductive contacts are electrically coupled to at least some of said second conductive contacts and said third conductive contacts.

11. The separable electrical connector assembly of claim 10, wherein each of said first conductive protrusions, said second conductive protrusions, and said third conductive protrusions is a conductive bump.

12. The separable electrical connector assembly of claim 10, wherein said first conductive protrusions, said second conductive protrusions, and said third conductive protrusions are solder bumps, each of said solder bumps being heat fused to form the metallurgical bond with one of said first conductive contact pads and said second conductive contact pads.

13. The separable electrical connector assembly of claim 10, wherein said first conductive protrusions, said second conductive protrusions, and said third conductive protrusions are conductive bumps, each of said conductive bumps carrying a heat fusible conductive material, said heat fusible conductive material being heat fused to form the metallurgical bond with one of said first conductive contact pad and said second conductive contact pads.

14. The separable electrical connector assembly of claim 10, wherein said first conductive protrusions, said second conductive protrusions, and said third conductive protrusions are conductive bumps, and each of said first conductive contact pads and said second conductive contact pads carries a heat fusible conductive material, said heat fusible conductive material being heat fused to form the metallurgical bond with one of said first conductive contact pads and said second conductive contact pads.

15. The separable electrical connector assembly of claim 10, wherein each of said first conductive protrusions, said second conductive protrusions, and said third conductive protrusions comprises one of the group consisting of copper, gold, silver, palladium, tin, and solder.

16. The separable electrical connector assembly of claim 10, further including means for decoupling the metallurgical bonds from at least a portion of stress produced by separation of said first connector body from said socket engagement of said first connector body with said socket and at least a portion of stress caused by thermal expansion between said first connector body and said first printed circuit substrate and between said second connector body, said third connector body, and said second printed circuit substrate.

17. The separable electrical connector assembly of claim 16, wherein the decoupling means includes said first flex circuit, said second flex circuit, and said third flex circuit.

18. The separable electrical connector assembly of claim 17, wherein the decoupling means includes a first compliant layer disposed between said first connector body and said first flex circuit, a second compliant layer disposed between said second connector body and said second flex circuit, and a third compliant layer disposed between said third connector body and said third flex circuit.

19. The separable electrical connector assembly of claim 16, wherein the decoupling means includes a first adhesive layer bonding said first connector body and said first printed circuit substrate, a second adhesive layer bonding said second connector body to said second printed circuit substrate, and a third adhesive layer bonding said third connector body to said second printed circuit substrate.

20. The separable electrical connector assembly of claim 16, wherein the decoupling means includes one or more first standoffs coupled between said first connector body and said first printed circuit substrate, one or more second standoffs coupled between said second connector body and said second printed circuit substrate, and one or more third standoffs coupled between said third connector body and said second printed circuit substrate.

21. The separable electrical connector assembly of claim 10, wherein at least one of said first printed circuit substrate and said second printed circuit substrate is a printed circuit board.

22. The separable electrical connector assembly of claim 10, wherein said at least one of said first printed circuit substrate, said second printed circuit substrate, and said third printed circuit substrate is a flex circuit.

23. A process for electrically interconnecting at least one conductive protrusion on a connector body to at least one conductive contact pad on a circuit substrate, the process comprising the following steps:

providing an insulative adhesive layer between the at least one conductive protrusion on the connector body and the at least one conductive contact pad on the circuit substrate and orienting the adhesive layer to form a bond between at least a portion of the connector body and the circuit substrate;

aligning the at least one conductive protrusion on the connector body with the at least one conductive contact pads on the circuit substrate; and activating the insulative adhesive layer to pressure engage the at least one conductive protrusion on the connector body with the at least one conductive contact pad on the circuit substrate, thereby electrically coupling the at least one conductive protrusion to the at least one conductive contact pad.

24. The process of claim 23, wherein the conductive protrusion comprises a conductive bump.

25. The process of claim 23, wherein the conductive protrusion comprises one of the group consisting of copper, gold, silver, palladium, tin, and solder.

26. The process of claim 23, wherein said connector body includes means for decoupling said bond from at least a portion of stress produced by separation and/or engagement of said connector body from a separable electrical connector assembly and at least a portion of stress caused by thermal expansion between said connector body and said printed circuit substrate.

27. The process of claim 26, wherein the decoupling means includes a flex circuit attached to said connector body, said conductive protrusions being formed over said flex circuit.

28. The process of claim 27, wherein the decoupling means further includes a compliant layer disposed between said connector body and said flex circuit.

29. The process of claim 26, wherein the decoupling means includes one or more standoffs coupled between said connector body and said printed circuit substrate.

30. The process of claim 23, wherein said circuit substrate is a printed circuit board.

31. The process of claim 23, wherein said circuit substrate is a flex circuit.

32. A process as claimed in claim 23, wherein the insulative adhesive layer is comprised of an adhesive selected from the group consisting of heat-bondable adhesives, heat-curable adhesives, and UV-curable adhesives.

33. A process as claimed in claim 32, wherein the heat bondable adhesive comprises a thermoplastic.

34. A process as claimed in claim 32, wherein the heat curable adhesive comprises an epoxy.

35. A process as claimed in claim 32, wherein the UV-curable adhesive comprises an acrylic.

36. A process as claimed in claim 23, further comprising the step of metallurgically bonding the conductive protrusions and the contact pads.

* * * * *